United States Patent [19]

Kushnick et al.

[11] Patent Number: 4,594,851

[45] Date of Patent: Jun. 17, 1986

[54] FLAMEHOLDER WITH REMOVABLE FLAMEHOLDER ATTACHMENTS

[75] Inventors: Steven B. Kushnick, Palm Beach Gardens; Gunther Eichhorn, Jupiter, both of Fla.

[73] Assignee: The United States of America as represented by the Secretary of the Air Force, Washington, D.C.

[21] Appl. No.: 724,720

[22] Filed: Apr. 18, 1985

Related U.S. Application Data

[63] Continuation of Ser. No. 562,263, Dec. 16, 1983, abandoned.

[51] Int. Cl.[4] ..... F02C 1/00

[52] U.S. Cl. ..... 60/261; 60/749

[58] Field of Search ..... 60/261, 749, 39.31, 60/39.32

[56] References Cited

U.S. PATENT DOCUMENTS

| | | | |
|---|---|---|---|
| 2,979,900 | 4/1961 | Hopper | 60/261 |
| 3,056,261 | 10/1962 | Krabacher et al. | 60/261 |
| 3,236,048 | 2/1966 | Spears, Jr. | 60/749 |
| 3,269,115 | 8/1966 | Nelson, Jr. | 60/749 |
| 3,800,527 | 4/1974 | Marshall et al. | 60/749 |
| 3,999,378 | 12/1976 | Tatem, Jr. et al. | 60/749 |
| 4,064,691 | 12/1977 | Nash | 60/39.06 |

*Primary Examiner*—Leonard E. Smith
*Assistant Examiner*—Donald E. Stout
*Attorney, Agent, or Firm*—Donald J. Singer; Bobby D. Scearce; John R. Flanagan

[57] ABSTRACT

An improved flameholder has a plurality of flameholder attachments removably mounted in cutouts in the downstream edge of a shroud of the flameholder. Each attachment includes a support plate which fits into one of the cutouts and a plurality of fan gutter flameholding elements rigidly mounted on the plate. A slip joint links the plate to the shroud and stiffeners which are fastened together connect each flameholding element to the shroud.

6 Claims, 4 Drawing Figures

FLAMEHOLDER WITH REMOVABLE FLAMEHOLDER ATTACHMENTS

RIGHTS OF THE GOVERNMENT

The invention described herein may be manufactured and used by or for the Government of the United States for all governmental purposes without the payment of any royalty.

This is a continuation of application Ser. No. 562,263 filed Dec. 16, 1983, now abandoned.

BACKGROUND OF THE INVENTION

1. Field of the Invention

The present invention broadly relates to gas turbine engines having afterburners and, more particularly, is concerned with a plurality of attachments for removably mounting a flameholder in the afterburner so as to facilitate removal through an exhaust nozzle of the engine.

2. Description of the Prior Art

In order to increase the effective thrust of a gas turbine engine for takeoff and climb and for periods of dash of the aircraft, It is advantageous to augment the engine thrust by injecting and burning additional fuel in an afterburner system. The afterburner system would be located in the engine between the turbine and the discharge nozzle.

It has been the practice in afterburner systems to use fixed baffles as flameholders at such location. One of the more common forms of the fixed baffle is a V-shaped fan gutter having its apex pointing upstream toward the turbine. A plurality of these fan gutters are rigidly attached to an annular flameholder shroud to form a one-piece unit having a fan-like configuration.

Flameholders operate at very high temperatures and therefore have a short operating life relative to most other parts of the engine. Therefore, it is necessary that a flameholder be replaced and a new one installed periodically during the longer operating life of the engine. The most desirable route for removing the flameholder is through the engine exhaust nozzle. However, currently the flameholder unit has an overall diameter which is larger than the diameter of the discharge nozzle opening. Thus, up to now a portion of the engine must be disassembled in order to remove the flameholder unit. Consequently, a need exists for an improved flameholder attachment that will facilitate removal of the flameholder through the engine discharge nozzle without requiring time-consuming and costly downtime of the engine and aircraft.

SUMMARY OF THE INVENTION

The present invention provides a removable flameholder attachment designed to satisfy the aforementioned need. In accordance with the principle of the invention, the flameholder is segmented into a plurality of attachments, each attachment being composed of several fan gutters, for instance three, mounted to a common support plate. Each attachment support plate is, in turn, coupled to an annular shroud of the flameholder. In actuality, peripheral sections of the shroud as it existed heretofore have now become the support plates which are attached to the shroud at a slip joint and held in position by braces interconnecting the fan gutters and the shroud. For replacing the flameholder, now individual attachments are detached from the flameholder shroud and easily removed through the exhaust nozzle. This significantly reduces the time required to remove the parts of the flameholder from the engine which have the shorter operating life and need more frequent replacement.

Accordingly, the present invention is directed to an improved flameholder in the afterburner of a gas turbine engine. The flameholder includes an annular shroud having a trailing edge defining a series of peripheral openings and a plurality of flameholder attachments removably mounted in the peripheral openings of the shroud. Each attachment includes at least one flameholding element and a support place mounting the element and removably fitted into one of the peripheral openings in the shroud. The trailing edge of the shroud at each opening and a leading edge of each support plate define a slip joint for linking the shroud and each attachment. Brace means also interconnect the flameholding element and shroud to hold the attachment in its mounted position on the shroud.

DETAILED DESCRIPTION OF THE INVENTION

Figure 1:
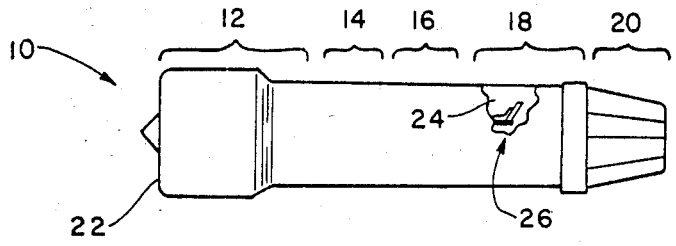
FIG. 1 is a side elevational schematical representation of a gas turbine engine, with a portion broken away to show the location of the flameholder in the afterburner of the engine.

Referring to the drawings, and more particularly to FIG. 1, there is shown a gas turbine engine, generally designated 10, incorporating the present invention. The engine 10 includes a compressor section 12, a burner section 14, a turbine section 16, an afterburner section 18, and an exhaust nozzle 20. In operation, air enters an inlet 22 to the engine at compressor section 12 and is compressed by a fan (not shown) in the compressor section. A portion of the compressed air then passes through an outer annular air passage 24 and into the afterburner section 18. The remainder of the air from the compressor section 12 is further compressed therein and enters the burner section 14 where it is heated due to combustion which takes place therein. The heated gas is then passed through turbine section 16, where sufficient energy is extracted to drive the compressor section 12, and then is discharged into the afterburner section 18 for eventual discharge to atmosphere through the exhaust nozzle 20.

Figure 2:
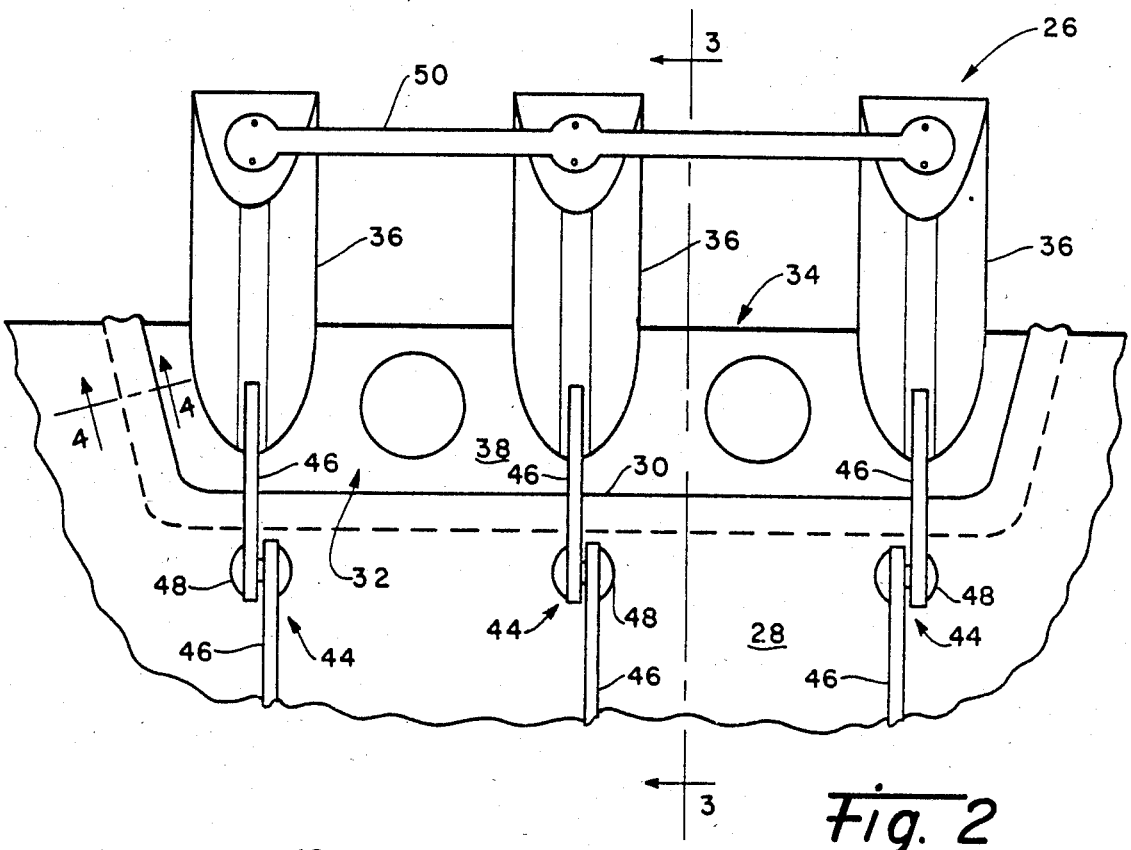
FIG. 2 is an enlarged fragmentary plan view of the improved flameholder of the present invention illustrating its shroud and one of the removable flameholder attachments.
Figure 3:
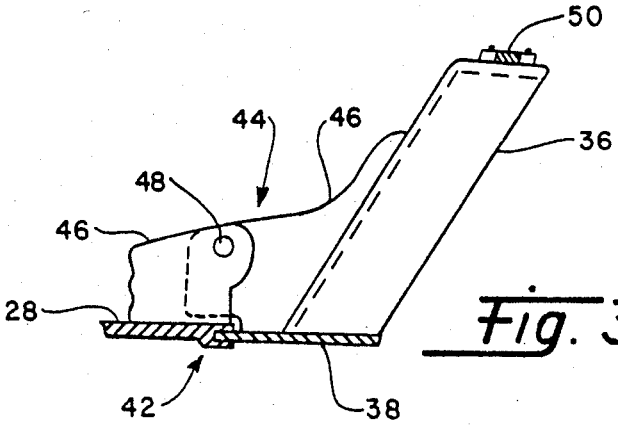
FIG. 3 is a fragmentary side elevational view of the improved flameholder taken along line 3—3 of FIG. 2, partly in section and on a smaller scale than that in FIG. 2.

As seen schematically in FIG. 1 and in more detail in FIGS. 2 and 3, an improved flameholder 26, comprising the present invention, is disposed in afterburner section 18. The flameholder 26 performs its conventional function of creating a flame stabilization zone in the afterburner where cooler bypass air and hotter combustion gas from the turbine section will mix together and, upon injection of additional fuel, ignite and increase the energy level of the hot gas stream exhausted from the engine exhaust or discharg nozzle 20.

The improved flameholder 26 includes an annular shroud 28 having a trailing or downstream edge 30 defining a series of cutouts o openings 32 (only one of which is shown in FIG. 2) in the downstream end of the shroud and a plurality of flameholder attachments (again, only one of which is shown in FIG. 2), generally designated 34, removably mounted to the shroud 28 in the peripheral openings 32 therein. Each flameholder attachment 34 includes at least one flameholding element 36, and preferably three, as well as support plate 38 which is removably fitted within one peripheral opening in the shroud and rigidly mounts the flameholding elements 36 in a rearwardly inclined orientation. Each flameholding element 36 is in the form of a V-shaped fan gutter, preferably formed of sheet metal, and having its apex pointed upstream toward the inlet end 22 of the engine 10.

Figure 4:
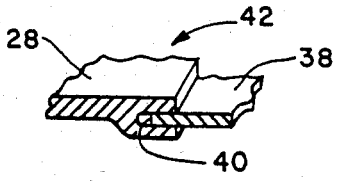
FIG. 4 is an enlarged fragmentary cross-sectional view of the slip joint linking together the flameholder shroud and the fan gutter support plate of one attachment.

For holding each flameholder attachment 34 in one of the shroud openings 32, the trailing edge 30 of the shroud 28 at its peripheral opening 32 and a leading or upstream edge 40 (FIG. 4) of the attachment support plate 38 together define a slip joint, generally designated 42, for linking or coupling the shroud 28 and attachment 34 together. Also, brace means, generally designated 44, in the form of a pair of stiffeners 46 which are individually rigidly connected to the shroud 28 and flameholding element 36 respectively and to one another by a bolt 48, interconnect each flameholding element 36 and the shroud 28 so as to hold the attachment in its desired mounted position on the shroud 28. A rigid strap 50 also interconnects the upper ends of the flameholding elements 36 together for purposes of increasing their resistance to vibration.

It should be understood that a different number of flameholding elements 36 than three could be mounted on a given support plate. Also, a clevis or some other comparable device could be used to fasten the stiffeners 46 together. By detaching the stiffeners from one another, the attachment 34 may easily be withdrawn and removed from the flameholder shroud 28 for replacement by a new one. This allows the flameholder to be removed in sections from the engine through the opening of the exahust nozzle 20.

It is thought that the improved flameholder of the present invention and many of its attendant advantages will be understood from the foregoing description and it will be apparent that various changes may be made in the parts thereof without departing from the spirit and scope of the invention or sacrificing all of its material advantages, the form hereinbefore described being merely a preferred or exemplary embodiment thereof.

We claim:

1. An improved flameholder structure for the afterburner of a gas turbine engine, comprising:

a. an annular shroud defined within said afterburner, said shroud including a trailing edge defining a plurality of peripheral openings therein;

b. a plurality of flameholder attachments supported entirely by said shroud, one of said flameholder attachments mounted within each peripheral opening, each of said flameholder attachments including a support plate for removably mounting said flameholder attachments within said peripheral openings, at least one radially extending flameholding element mounted on each support plate, said trailing edge of said shroud at each peripheral opening having a continuous channel defined therein, said channel having a shape complementary to a leading edge of said support plate, said channel and leading edge of said support plate together defining a slip joint means for fixedly connecting said flameholder attachments to said shroud; and c. brace means connecting said at least one radially extending flameholding element to said shroud for holding the flameholding element on said support plate.

2. The improved flameholder structure as recited in claim 1 wherein each of said flameholder attachments includes three radially extending flameholding elements secured together at their outer ends by a rigid strap.

3. The improved flameholder structure as recited in claim 1, wherein said brace means includes a first stiffener member rigidly connected to said shroud, a second stiffener member rigidly connected to the flameholding element and means for detachably connecting said first and second stiffener members together.

4. The improved flameholder structure as recited in claim 2, wherein each of said flameholder elements is in the form of a V-shaped fan gutter having its apex pointed upstream toward the inlet of said engine.

5. An improved flameholder structure for the afterburner of a gas turbine engine, comprising:

an annular shroud defined within said afterburner, said shroud including a trailing edge defining a plurality of peripheral openings therein;

a plurality of flameholder attachments supported entirely by said shroud, one of said flameholder attachments mounted within each peripheral opening, each of said flameholder attachments including a support plate for removably mounting said flameholder attachments within said peripheral openings;

a plurality of radially extending flameholding elements mounted on each support plate;

said trailing edge of said shroud at each peripheral opening having a continuous channel defined therein, said channel having a shape complementary to a leading edge of said support plate, said channel and leading edge of said support plate together defining a slip joint means for fixedly connecting said flameholder attachments to said shroud; and a plurality of individual brace means for holding said flameholding elements on said support plate, said individual brace means including first stiffener members rigidly connected to said shroud, a second stiffener member rigidly connected to each of said flameholding elements, and means for detachably connecting said first and second stiffener members together.

6. The improved flameholder structure as recited in claim 5, wherein said radially extending flameholding elements are secured together at their outer ends by a rigid strap.

* * * * *